United States Patent [19]

Wu et al.

[11] Patent Number: 4,852,782

[45] Date of Patent: Aug. 1, 1989

[54] EQUIPMENT FOR PLAYING GOLF

[76] Inventors: Ko-Lee Wu, 34d Floor, No. 5, Alley 9, Lane 56, Hou-Kang Street, Shih-Lin District, Taipei 11154; Ming-Chi Huang, 2nd Floor, No. 4-1, Alley 4, Lane 74, Hsin-I Rd, Sec. 4, Taipei 10656, both of Taiwan

[21] Appl. No.: 5,673

[22] Filed: Jan. 21, 1987

[51] Int. Cl.[4] ..... A63B 53/02

[52] U.S. Cl. ..... 224/226; 224/222; 224/918; 273/80.1; 206/315.2

[58] Field of Search ..... 273/77 A, 162 R, 81 R, 273/81.2, 80 R, 80 D, 80.1, 80.2; 206/315.2, 315.3, 315.4, 315.5; 224/151, 226, 227, 222, 242, 918

[56] References Cited

U.S. PATENT DOCUMENTS

| | | | |
|---|---|---|---|
| 782,955 | 2/1905 | Emens | 273/80.1 |
| 3,829,092 | 8/1974 | Arkin . | |
| 3,848,737 | 11/1974 | Kenon | 273/80.1 |
| 3,891,212 | 6/1975 | Hill | 273/80.1 |
| 4,165,874 | 8/1979 | Lezatte et al. | 273/77 A |
| 4,253,666 | 3/1981 | Murphy . | |
| 4,597,577 | 7/1986 | Lamanna | 273/80.1 |

*Primary Examiner*—Renee S. Luebke
*Attorney, Agent, or Firm*—Cushman, Darby & Cushman

[57] ABSTRACT

A set of equipment for playing golf. The set includes a full set of golf club heads, i.e., irons 404 and woods 405; a shaft 101 capable of ready disassembly or assembly of a selected head, e.g., 404*a* and capable of length adjustment accordingly by an adjustment grip 113; graspable transportation means for the full set of heads 404, 405, usually as a carrying bag 402 openable at the top at 402, 403, and including a partitioned drawer 407 for smaller items 407, for carrying all of the equipment to or from the golf course; wearable carrying means for a selected smaller group of heads for actual play, utilizing a waist-belt-mounting 201 or 301 with (a) either boxes 203 mounted on the belt 201 (each box for holding one wood or two iron heads with downwardly protruding necks) and/or on a leg strap 202 or (b) a pair of identical rear thigh straps 302 with head-carrying loops 303 of different shapes and arrangements whereby in either case the carried heads and other pieces of equipment are available for easy selection without interfering with movements during play.

11 Claims, 10 Drawing Sheets

401
403
404
405
4
402
3
303
302
301
2
201
212
203
407a
202
101
1
102
103
404a

FIG. 23
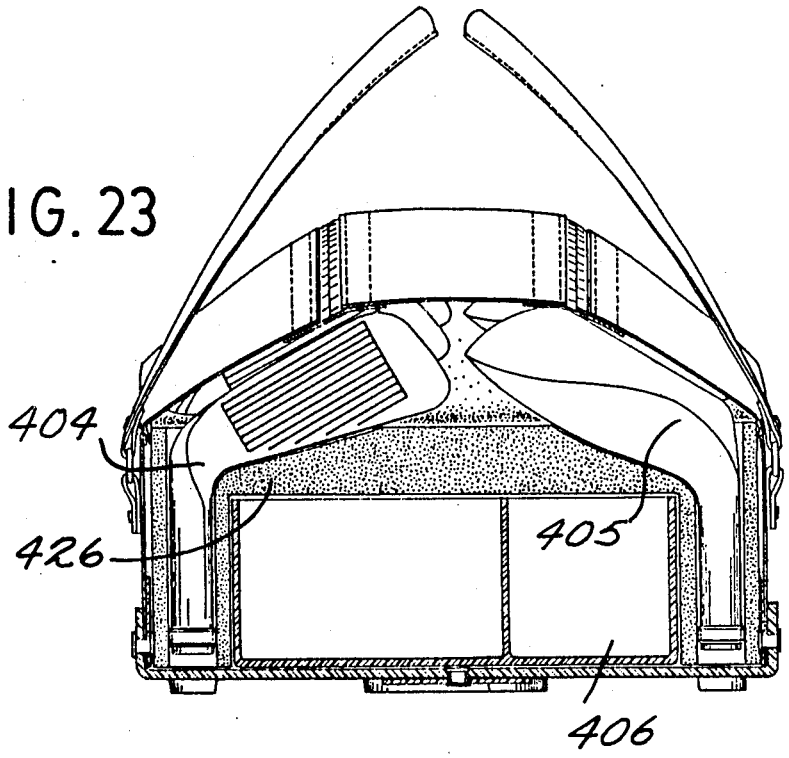
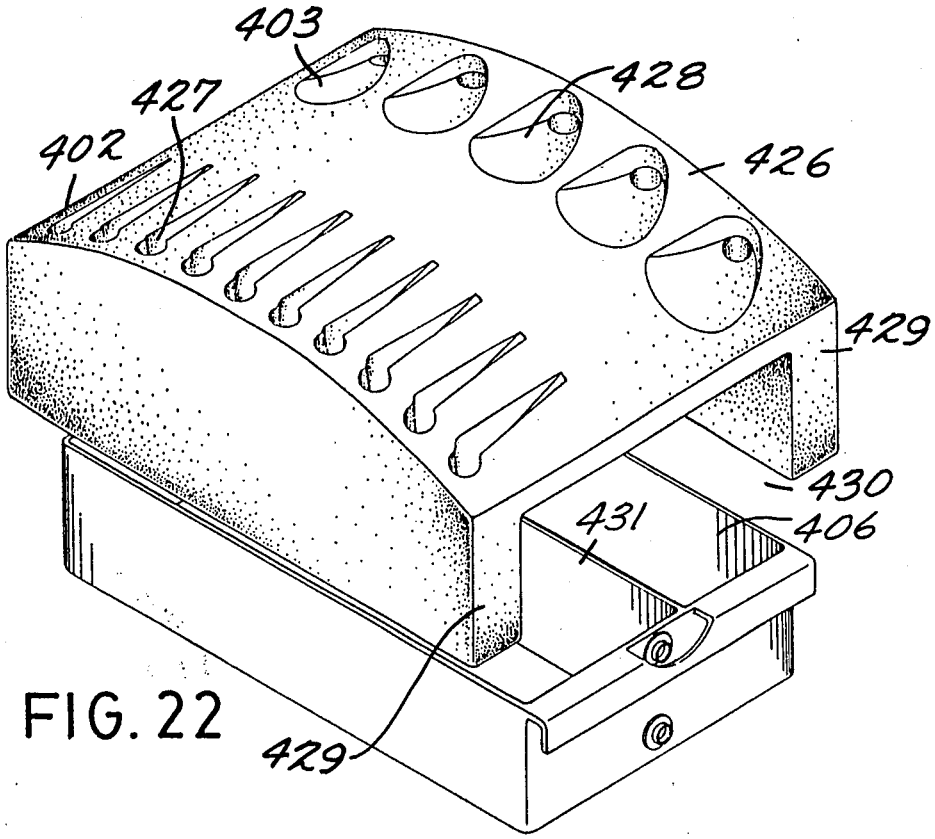
FIG. 22

EQUIPMENT FOR PLAYING GOLF

This invention relates to equipment for playing golf, of the general type comprising a set of club heads selectively interchangeable on a small number of shafts, or on one shaft, graspable transport means for such equipment and wearable devices to hold a selection of such equipment during an actual round of golf.

In its very earliest days golf was played using a single club formed from a naturally-occurring wooden branch with a suitably angled and dimensioned "head". By the nineteenth century, and especially as the game became popularised outside of its origins in Scotland, golf clubs became refined to a slender wooden shaft with a wooden or iron club head fixed to its lower end. More recent improvements utilise developments in materials (e.g. carbon fibre) and refinements in the shape, weight and surface of the club head, but still use the conventional structure with the parts united and fixed to give one inseparable unit.

Golf is of course played over a varied terrain, and the ball can arrive during play in a variety of situations of "lies". Because of this, numerous specialised clubs have been included over the years to provide the facility as desired of high lofting shots, distance, or putting. Currently, official competition rules recognise 14 clubs, designated as numbers 1 to 5 woods (with predominantly wooden heads) and numbers 1 to 9 irons (with iron heads) of progressively varying face angle.

Although in actual play a lesser number of clubs may be stipulated for selection in accordance with anticipated conditions, there are inevitably a substantial number of such clubs to be carried around along with spare golf balls and ancillary equipment. This can be done with a large, and inescapably heavy, shoulder-carried bag; or with a wheeled trolley; or with a motorised golf-course cart or trolley; and not infrequently involves the expense and distraction of hiring a caddie for this purpose.

All of this adds to the complication and expense of the game, and distracts from its pleasant environment or the intrinsically personal and solitary test of skill.

The present invention sets out to provide golfing equipment which restores some of the simplicity to the game by being lighter and easier to carry (both as a full set, for pre-match and post-match) transport, and as a selected set while playing of small dimension and of relatively inexpensive construction, without loss of effective playing capability.

In one aspect the invention consists a set of equipment playing golf,comprising:

(a) a full conventional set of golf club heads (b) a shaft, configured (i) at one end for ready assembly or disassembly of a selected head and for locking of the head into position between such assembly and disassembly and (ii) at the other end for ready relative longitudinal adjustment of an end grip portion to give different selected effective shaft lengths;

(c) graspable transportation means dimensioned and shaped to accommodate the said full set of golf club heads; and (d) at least one wearable carrying means to accommodate a selection of such heads during a round of golf, secured to of part of a waist belt in such a location as not to interfere with a players movements and presenting the heads for ready choice of a selected head for interchange on the shaft when necessary.

preferably, the assembly configuration between the shaft and any head comprises:

(a) on the head, a straight hollow neck of generally cylindrical internal form and possessing towards the inner end of the cylindrical hollow an internal collar with a pair of opposed diametral interruptions.

(b) on the shaft, a cylindrical end portion dimensioned to fit within the cylindrical hollow, having an endmost region which is of a smaller diameter and possesses a paid of opposed diametral protrusions, capable of passage through the interrupted portions of the internal collar within the neck and capable of engagement beneath the collar when the shaft is twisted through 90° relative to the head.

This important and ma)or feature of the invention may be best provided by forming the shaft/head assembly to provide (a) on the head.

(a) on the head (i) a liner member fixed within the neck to define the cylindrical hollow and interrupted shoulder.

(ii) external screw threads spaced from the end of the neck.

(iii) two sloping edges each extending around one-quarter of the perimeter of the end of the neck to a stop surface.

(b) on the shaft (i) a connecting rod extending from a tubular shaft end to exhibit the endmost region with its diametrically opposed protrusions, (ii) a diametral pin extending through the tubular shaft end and connecting rod, to project to either side of the shaft inwards from its end, (iii) an internally threaded conical sleeve slidable on the shaft until it engages the projecting pin ends, and engageable with the neck external threads: whereby (i) when the connecting rod endmost portion is pushed past the interrupted collar, it can be relatively twisted with the pin ends passing down the neck and sloping edges until the stop surfaces are encountered and (ii) when the conical sleeve is engaged with the external neck threads the assembly is tightened.

Preferably, moreover,the assembly configuration between the shaft and its length-adjustable grip comprises (a) towards the rearward end of the shaft, at least one axially protruding pin, and (b) within the cylindrically hollow grip around the said rearward shaft end a longitudinally extending groove and a plurality of spaced side grooves communicating therewith, all dimensioned to accommodate the protruding pin end;

whereby (a) the shaft and grip can be relatively twisted out of a first longitudinally stable configuration at which the pin end lies in a side groove, into a second configuration in which the pin lies in the longitudinally extending groove (b) the shaft and grip can be relatively moved longitudinally and (c) the shaft and grip can be relatively twisted back into a second longitudinally stable configuration with the pin end in another side groove.

Such an assembly is most preferably formed to exhibit:

(a) at a shaft rearward tubular end a stopper secured by two spaced pins protrudingly axially from the shaft, and (b) a two-part grip comprising an external cover and an internal liner fixed therein and exhibiting a straight longitudinal groove with a plurality of side grooves, equispaced at a distance equal to the pin separation on the shaft, communicating therewith; the forward end of the liner extending from the external cover around the shaft, being split longitudinally into pressing fingers and being threaded externally to accommodate an internally threaded tightening collar turnable to tighten or loosen the fingers on the shaft and thereby to prevent, when tightened, undesired relative twisting.

The graspable transportation means usually further comprises locations for holding and transporting smaller ancillary equipment such as golf balls. It may include a separate holder for holding a full set of club heads, e.g one row of irons and one row of woods. This can be formed as a bridge-shaped moulded member including two rows of cylindrical recesses, one in each leg, to receive the golf club necks, and two rows of shaped grooves at an upper surface to prevent movement and damage of the heads. In such a case a drawer for holding ancillary equipment can be located between the legs of the bridge. The transportation means is preferably a bag with handles and/er a shoulder strap The wearable carrying means may comprises a waist belt having a plurality of upwardly openable lidded head-carrying boxes fixed around the belt in spaced locations not interfering with the players movement.

Alternatively or additionally it may comprise a waist belt having attached thereto a generally vertical leg or thigh strap with leg-encircling fastener strips projecting therefrom, the leg or thigh straps having a plurality of upwardly openable lidded head-carrying boxes fixed along the strap in spaced locations not interfering with the players movements.

Either such carrying means can be used with head-carrying boxes which have a generally rectangular floor with two holes towards opposite corners !hereof; whereby one club head of wood, or two of iron, can be accommodated per box with neck portions extending downwards through the holes.

A different form of carrying means may comprise a waist belt portion integral with support flaps extending in use one down the rear part of each thigh, said support flaps comprising on their surfaces holder loops for accommodating selected golf club heads. Thus a row of internally conical loops may be provided to hold selected iron golf club heads by their necks, and/or internally conical loops may be provided in spaced relationship to elastic retaining loops for holding selected wooden golf club heads with their necks in the conical loops and their heads restrained from movement by the elastic loop.

It will be apparent therefore from the above general description that the present invention is a convenient second, or spare, golf set. For the average golfer, participating in unofficial competition, or in vacation. or when travelling abroad, is burdensome if the traditional golf set is used, and a second, portable, golf set as in the present invention is obviously a convenient way of solving this problem. The portable characteristics of the present invention also enable beginners to learn in an easier fashion.

Also, one reason why golf is not even more popular is its expensiveness. (being an outdoor sport only for these with above-average affluence) and this expense turns mainly on the golf club set and the caddie charges. In proportion. the charges for golf links are very cheap. With the present invention, the golfer can avoid caddie charges because he can carry the portable golf set by himself. Expenditure can be greatly reduced, and a wider range of persons can enjoy the game.

The invention will be further described with reference to the accompanying drawings, in which:

FIG. 22 shows in exploded form two internal structural component parts of the bag shown in FIG. 21.

FIG. 23 is a section across XXIII—XXIII of FIG. 21, and

FIG. 1 shows a few main subdivisions of the kit of equipment.

Figure 1:
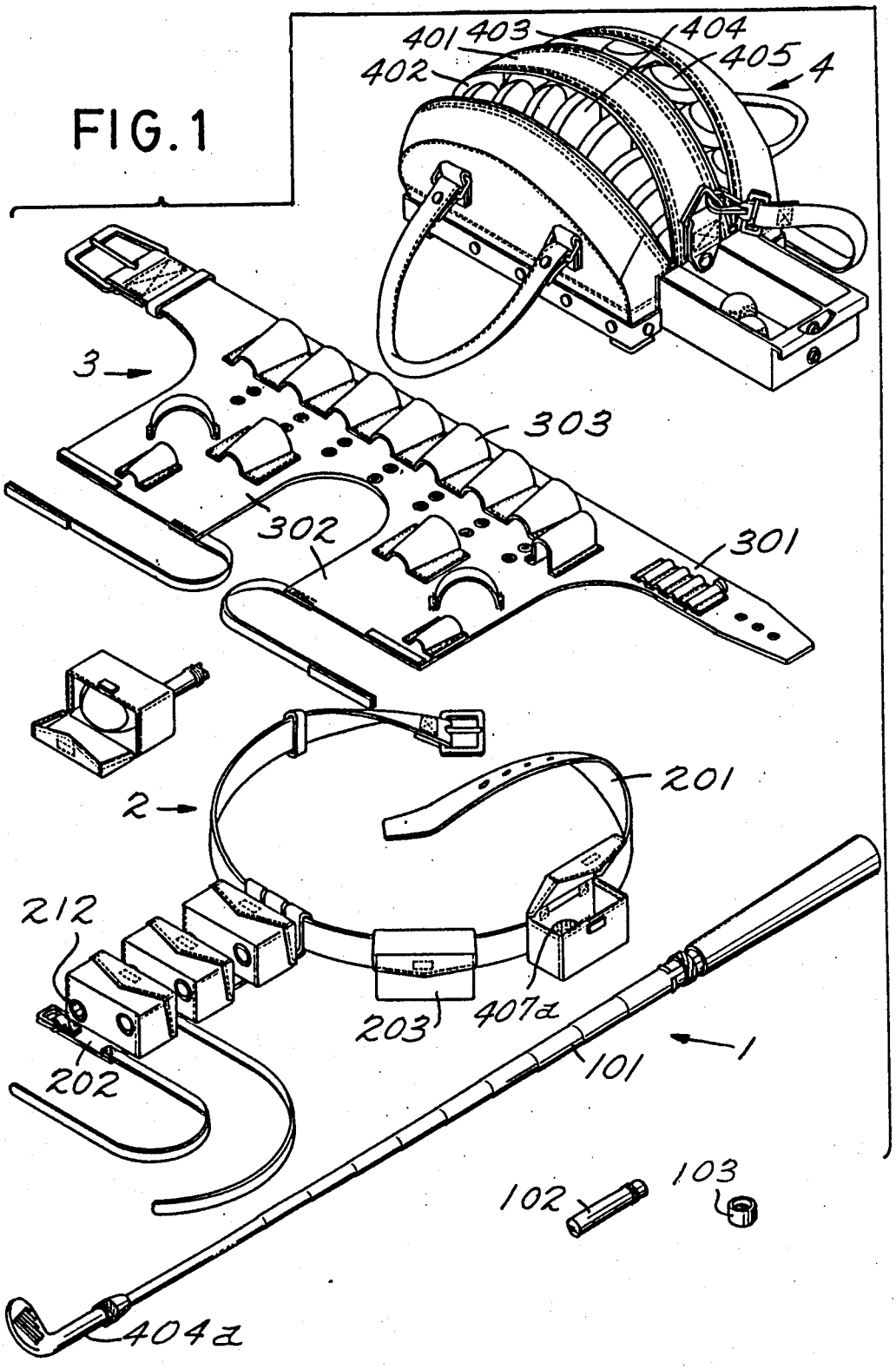
FIG. 1 shows in laid-out form one example to component parts usable to form a set of golf equipment in accordance with the present invention.

A shaft set 1 comprises a shaft 101, with a club head assembled thereto and examples of temporary covers 102. 13 for disassembled ends of the shaft or club head .

A carrying set 2 comprises a waist belt 201. a leg strap 202 and boxes 203 for club heads (one shown in position in a removed box). The boxes 203 can be located on the leg strap 202 only, or on the waist belt 201 only (in which case the leg strap 202 can be dispensed with) or on both to the number of boxes required. The function of set 2 is to carry equipment for selective use during play, in a manner not interfering with the players game.

A carrying set 3 is also designed not to interfere with the same and comprises a waist belt 301 but has two leg flap supports 302 and a number of attached holders 303 primarily for club heads. It would not, of course, be worn at the same Lime as carrying set 2, but if present in the kit allows (a) selection of a preferred set, e.g. as between male and female wear, and (b) the facility of providing a competing player with suitable carrying equipment.

A transport set 4, for transport of equipment to and from the course,. but not during play, comprises a top-openable bag 401 with two parallel compartments or zones 402, 403 adapted to receive the club heads of nine irons 404 and five woods 405 respectively, and shaped to hold a drawer 406 for small items of play, primarily golf balls 407 but also tees, cards, pens or temporary covers 102. One iron **404*a* is shown removed from bag 401 and mounted on shaft 101; one wood 405*a* is similarly shown in one of the boxes 203**.

Other reference numerals used in FIG. 1 are for purposes of correlation with other Figures, described in more detail below.

Figure 2:
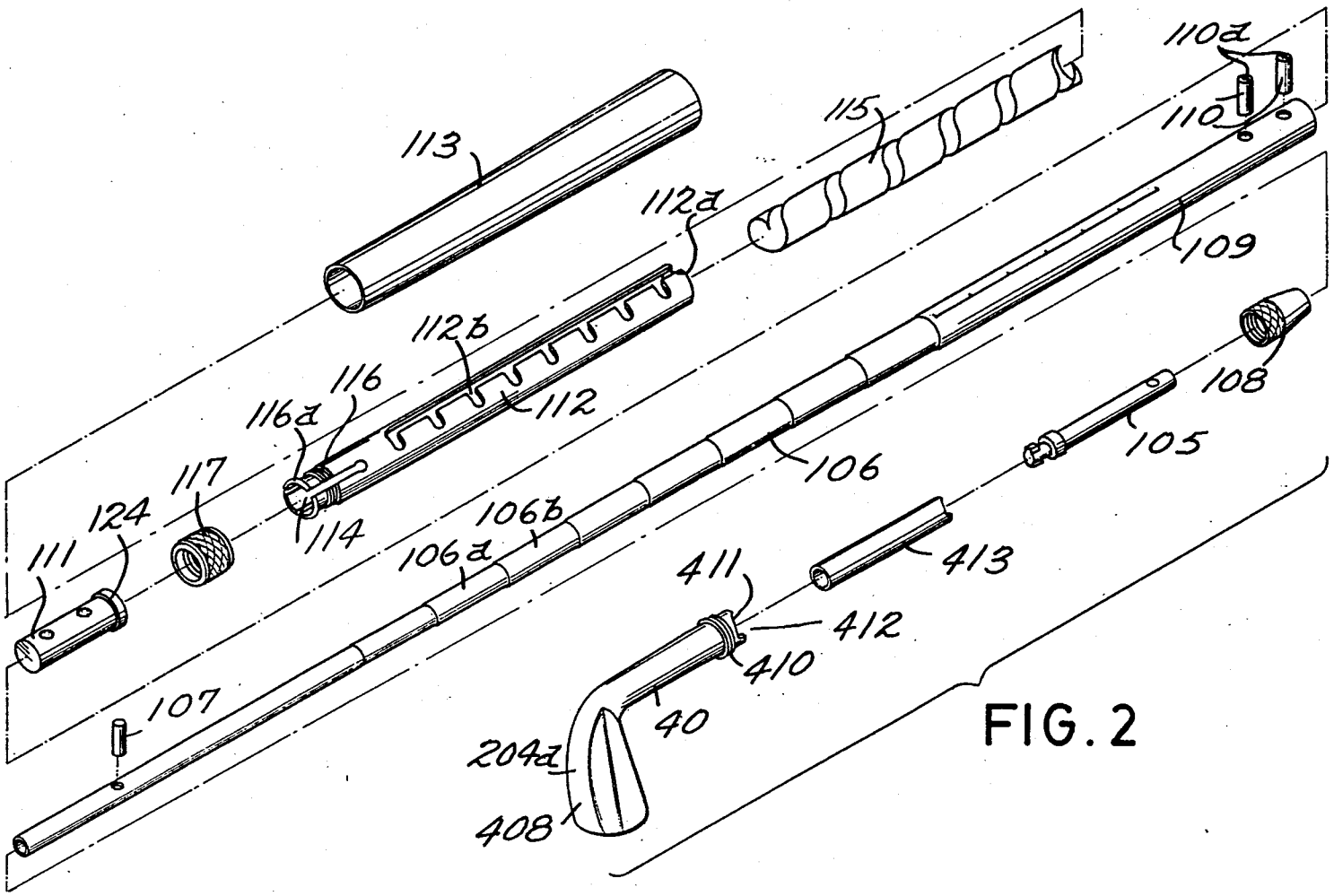
FIG. 2 shows in exploded form an example of the total assembly of the shaft and head of a golf club in accordance with the present invention.

The shaft 101 and a typical club head **404*a* are adapted for easy assembly and disassembly, and the shaft 101 can also be adjusted in length, all as shown in FIGS. 2 to 14. FIG. 2 shows the whole assembly in general exploded view; FIGS. 3 to 10 show the head/-shaft assembly; and FIGS. 11 to 14** the shaft/grip assembly.

The club head, shown as an iron **404*a*, possesses a body 408, a hollow neck 409, and an external screw thread 410 around the upper end of the neck. It is moreover configured, around its open end, with two diametrically opposed sloping end or rim surfaces 411 each terminating in a vertical stop 412 (see also FIG. 3**).

At the head end, the shaft 101 comprises a neck liner 413, configured to receive and retain, on twisting, a complementarily configured connecting rod 105 itself secured in relation to shaft main body 106 by transverse pin 107 over which fits internally threaded sliding collar 108 for attachment to threads 410. The exact nature of these attachments will be described in more detail below.

Shaft main body 106 is a tubular metal member extending towards the grip end with increasing diameter also as described below in more detail.

The grip end of the shaft 101 comprises a cylindrical tubular portion 109 of main body 106 to which is secured by two spaced transverse pins 110 an end plug 111. The pins 110 project at one end into a shaped length-adjustment groove **112*a* in a liner member 112 lining, the handle 113 and secured to the inner surface of the handle by double sided adhesive tape 115. The shaft end portion 109 is thus adjustable longitudinally with respect to the liner 112. To immobilize the shaft end portion 109 relative to the grip liner 112, longitudinal slots 112*a* are provided at the end of the liner to permit the tongues 116 thereby defined to be flexed against the shaft by internally threaded nut 117**.

The shaft/clubhead assembly will now be described in more detail.

Figures 3, 4, 5, 6, 7, 8, 9, 10:
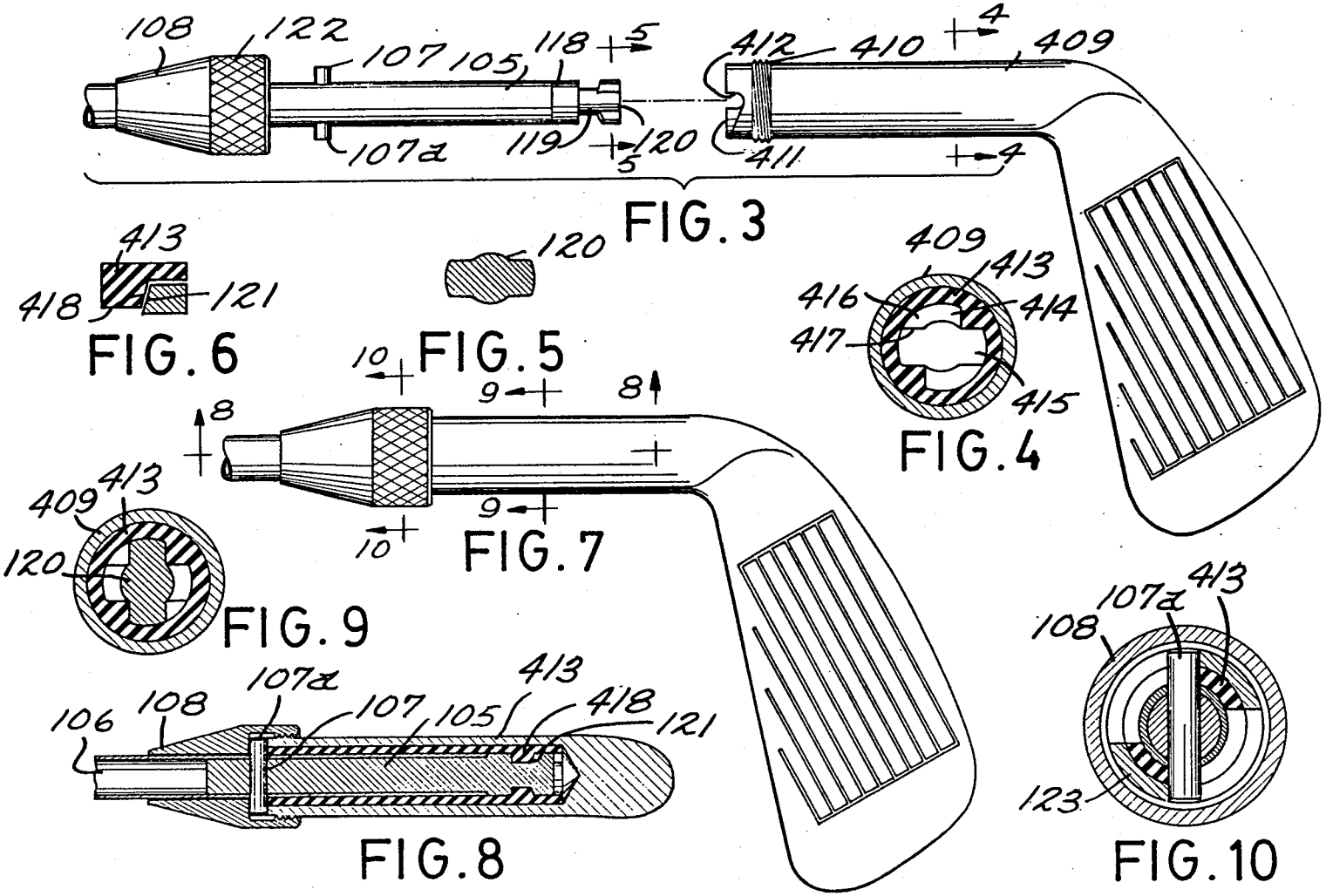
FIG. 3 shows in exploded form the shaft-to-head fitment of an example of a golf club in accordance with the present invention.
FIG. 4 is a section along IV—IV of FIG. 3.
FIG. 5 is a section across V—V of FIG. 3.
FIG. 6 is a longitudinal section of a detail illustrating part of the shaft-to-head fitment.
FIG. 7 shows the assembled head and shaft of FIG. 3.
FIG. 8 is a longitudinal section along VIII—VIII of FIG. 7.
FIG. 9 is a section across IX—IX of FIG. 7.
FIG. 10 is a section across X—X of FIG. 7.
Figure 11:
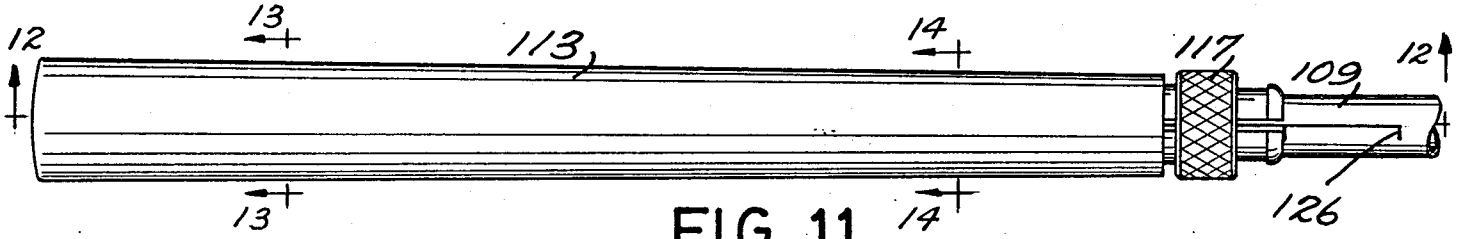
FIG. 11 shows an example of the handle or grip end of a golf club in accordance with the present invention.
Figure 14:
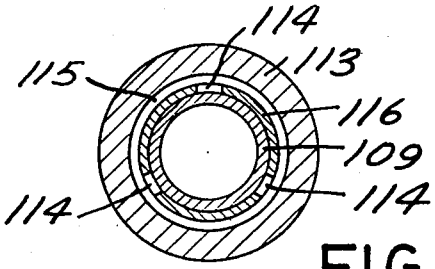
FIG. 14 is a section across XIV—XIV of FIG. 11.
Figure 13:
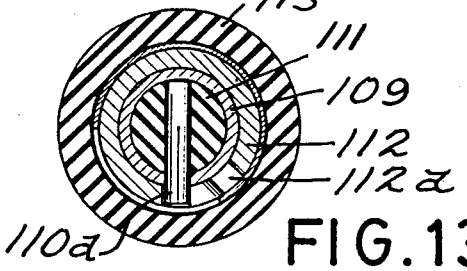
FIG. 13 is a section across XIII—XIII of FIG. 11.
Figure 12:
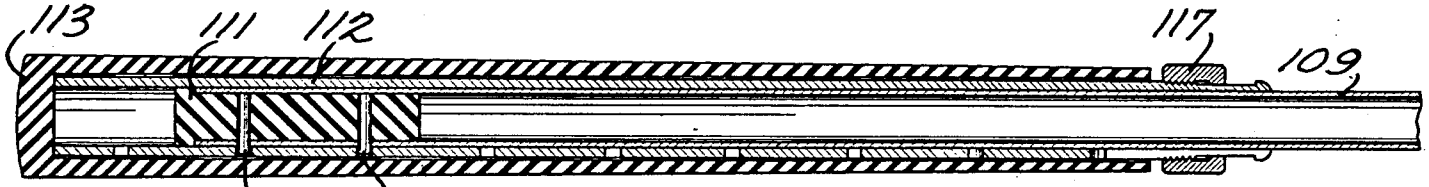
FIG. 12 is a section along XII—XII of FIG. 11.

Liner 413 (FIG. 4) is made of hard synthetic polymer and is glued within the hollow neck 409. It possesses rim surfaces 414 and stop surfaces 415 equivalent to those on the club neck 409. It also possesses, towards its inner end. an internal shoulder 416 with a broad diametral slot 417. The underside, or inner face, of the shoulder at 418 is slightly angled (FIG. 6).

Connecting rod 105 extends upwards into the narrow end of shaft body 106. It is secured in place by transverse pin 107, which extends outward from the shaft body 106 at its ends **107*a*. The rod 105 is provided with a shoulder 118 so that the rod projects forward, as a smooth continuation of shaft body 106, to an end region with neck 119 and forward locking configuration 120 shown in cross-section in FIG. 5. This looking configuration 120 is such that it can be passed through the broad diametral liner slot 417, and possesses on its upper (outer) face 121 a slight angle, equivalent to that on face 418 in the liner (see FIG. 6**).

Assembly of the head is effected by first pushing the shaft end and connecting rod 105, secured therein, down inside the liner 413 in such a relative orientation that locking configuration 120 passes through slot 417 in the liner secured within the neck 409 and then twisting the shaft and head relatively through 90°. This causes pin ends **107*a* to ride down sloping surfaces 411, 414 until encountering stop surfaces 412. 415. At this point the locking configuration has turned so that opposed sloping surfaces 121, 418** come into engagement.

Internally threaded sliding collar 108s is now turned finger-tight, using externally knurled gripping surface 122. over club neck threads 410. By virtue of its internal shoulder 123 it engages the ends **107*a* of pin 107 and thus locks and secures the whole assembled head structure. The thread sense at 410 is such that impact of the club head striking face 419 with a golf ball tends to tighten the collar 10S against the pin 107**. Disassembly takes place with a reverse series of operations.

The purpose of temporary covers 102, 103 will now be apparent. To save impact damage, clogging with earth, or water ingress the shaft end, when not assembled to a club head, can be temporarily covered by an end cover 102 screwed into collar 108 and thus accommodating the forward end of the shaft. Likewise, each club can have its own neck end cover 103, screwed over threads 410. In practice, although one of each are shown, the cover 102 per shaft and one cover 103 per head will be provided.

The shaft/grip assembly will now be described in more detail.

The shaft 106 proceeds from the narrow head end in a series of steps of increasing diameter as at **106*a*, 106*b***, etc, the steps being smoothed rather than abrupt. The effect is therefore of a more or less gentle taper.

However, a relatively longer end portion 109 is cylindrical, and possesses an internal stopper or plug 111 of hard polymeric material both glued to the shaft and mechanically secured by spaced transverse pins 110 each with one projecting end **110*a*. The stopper or plug 111 has an end shoulder 124 of the same external diameter as the shaft end 109. Around shaft end 109 fixed within the external gripping handle 113 by double-side adhesive tape 114 is a liner member 112. This liner 112 possesses a longitudinal slot 112*a*, communicating with side slots 112*b*, the spacing between adjacent side slots being equal to that between pin ends 110*a*. Accordingly, the shaft end 109 can be slid to-and-fro in relation to the line as long as the pin ends 110*a* remain in longitudinal slot 112*a*: but if the shaft is twisted relative to the liner, i.e. relative to the handle 113. The pin ends 110*a* will enter a pair of adjacent side slots 112*b* and prevent further such relative movement. This gives a shaft-length adjustment capability. To ensure that the shaft length stays at its desirable extent, screw collar 117 can be turned on screw threads 125 on a forward part of the liner, projecting from the handle. Since the forward end of the liner 112 is divided into flexible fingers 116 by three slots 114, these fingers 116 become pressed against shaft portion 109 and lock the assembly. Usually the thread sense will be such as to tighten upon club impact. The end-most parts 116***a* of fingers 116 are turned up to prevent loss of collar 117.

Adjustment of shaft length can be effected as between different players, or for the same played on different stokes. Indicia marks 126, on the shaft portion 109, can show the shaft length.

The above example of a length-adjustable and disassembable golf club manifests certain advantages.

Thus, at the head end there are three separate fixing means namely (a) the locking configuration 120 and its surfaces 121, 418 (b) the pin ends 107*a* against stop surfaces 412, 415 and (c) the collar 108, acting variously against tension, impact or longitudinal stresses. At the grip end there are two separate fixing means, namely (a) the pin ends 110*a* residing in side slots 112*b* and (b)the screw collar 117 forcing leaves 116 against the shaft 109; once again acting in different ways. This multiple security assists safety. Moreover, assembly can readily be such that normal playing stresses increase the integrity of the assembled joins Also, parts are repairable quickly and cheaply. Moreover the whole set becomes lighter and easy to transport and use Parts 2 and 3 of the set of equipment, used selectively for carrying the selected heads and ancillary equipment during actual play, will now b described.

FIGS. 15 to 19 correspond to general reference 2 in FIG. 1, and illustrate features of carrying equipment.

Figure 15:
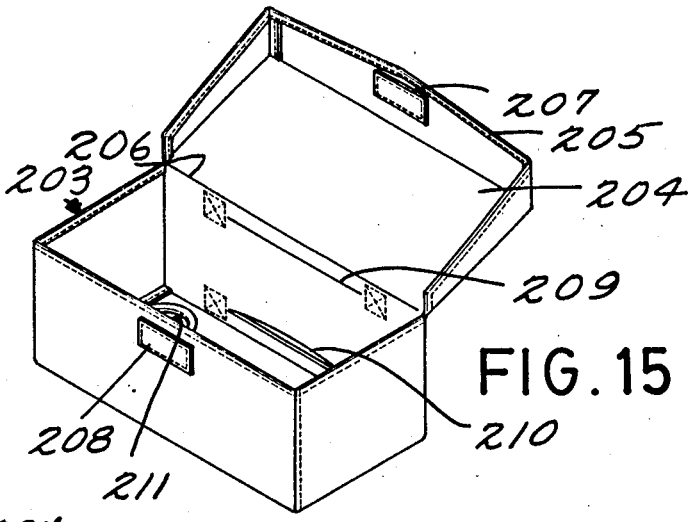
FIG. 15 shows an example of an opened, empty, club head carrying box from above, for carrying two club heads, in accordance with the invention.

FIG. 15 shows a stout leather box 203 with a lid 204 possessing a rim 205 around three sides and being foldable to close the box at the fourth side 206. Opposed complementary pads 207, 208 of polymer hook-and-loop material as known under the Registered Trade Mark VELCRO, or any other simple clasping attachment, can be used to keep the box shut when desired. The back of the box, under fold line 206, has two spaced parallel horizontal slits 209, 210. The base of the box has two holes 211, 212 in diagonally opposed corners, each reinforced with a metallic surround.

Figure 16:
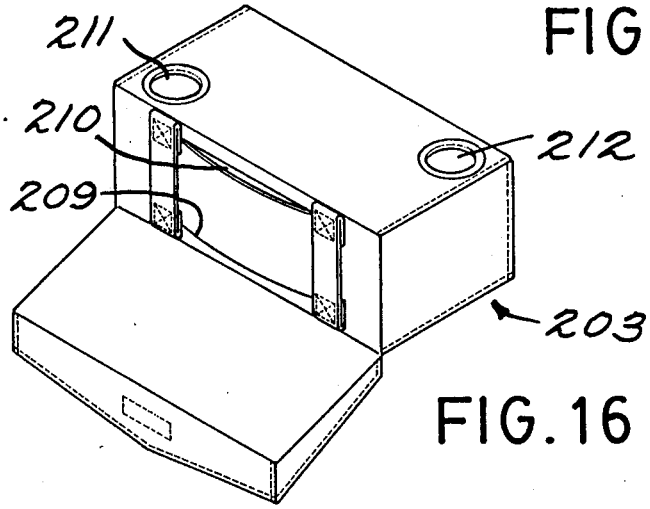
FIG. 16 shows the inverted opened empty box of FIG. 15.

FIG. 16 shows the box turned upside-down; a construction to prevent slits 209, 210 tearing, and the arrangement of holes 211, 212 can be clearly seen.

Figure 18:
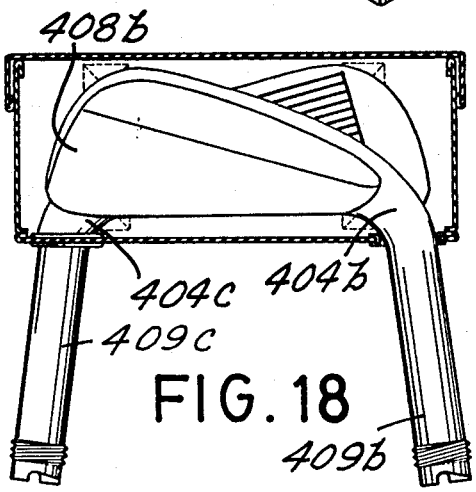
FIG. 18 is a box section along XVIII—XVIII of FIG. 17, showing the club head relative positions.
Figure 17:
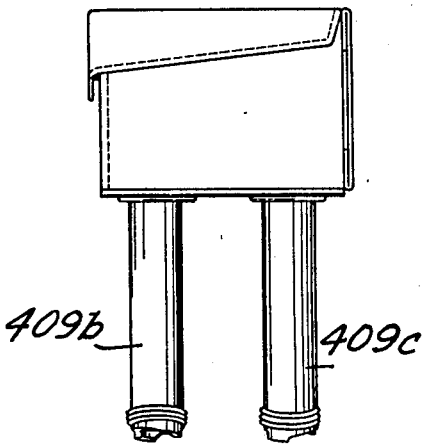
FIG. 17 shows from one side the box of FIGS. 15 and 16. closed, and containing two club heads.

FIGS. 17 and 18 illustrate the use of the box 203 to accommodate two iron club heads 404*b*, 404*c*. These are placed with neck portions 409*b*, 409*c*, one through each hole, so that bead portions 408*b*, 408*c* face each other, as in FIG. 18.

The box is so dimensioned as to accept two iron clubheads or, as shown generally in FIG. 1 a single wood club head in which case one hole 211 or 212 is unused.

If desired a cover piece 103 can be placed over each neck 409*b*, 409*c* until they are ready for use.

Figure 19:
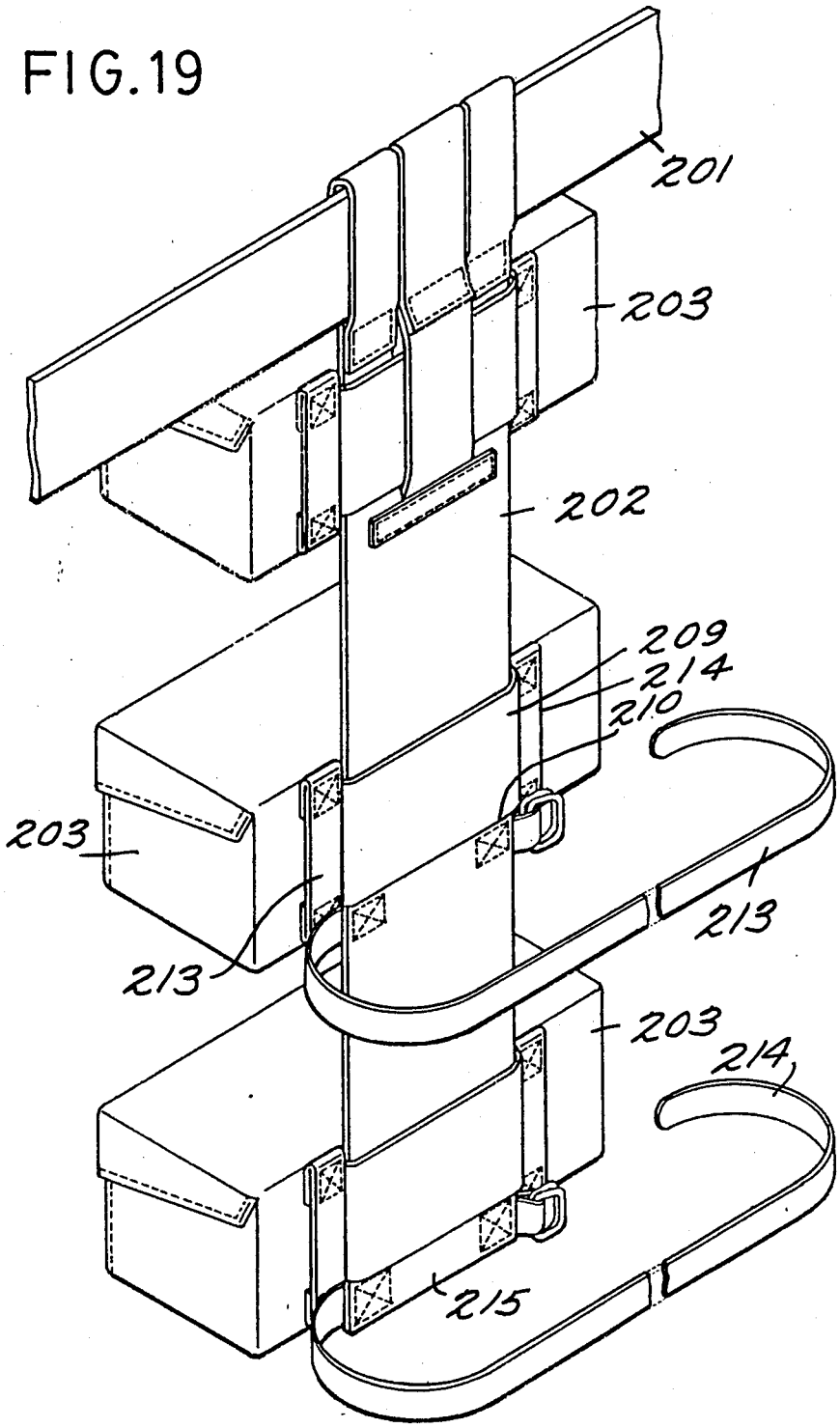
FIG. 19 shows three boxes of the type shown in FIGS. 15 to 18, from the rear, mounted on a leg strap provided with fixing belts including a waist-mounted belt.

FIG. 19 shows how the boxes are arranged on a support for wear by the user in one mode of use during play. A broad leather strap 202 passes through the slits 209, 210, the boxes 203 being localised on the strap 202 by stitched transverse strips 213,214 or by a suitable stitched configuration as shown at 215. At its upper end the strap 202 is attached to a conventional belt 201. As described in more detail below the belt goes round the user's waist and the strips 213, 214 are secured round his thigh, so that the strap 202 extends down one leg with boxes 203 presented for use.

FIG. 1 also shows generally that boxes such as 203 can be secured directly to the belt 201. This can be an alternative to the arrangement of FIG. 19, for carrying club heads, or can be an additional feature, in which case it ca be used for other items of play such as golf balls, shown at 407*a*.

Figure 20:
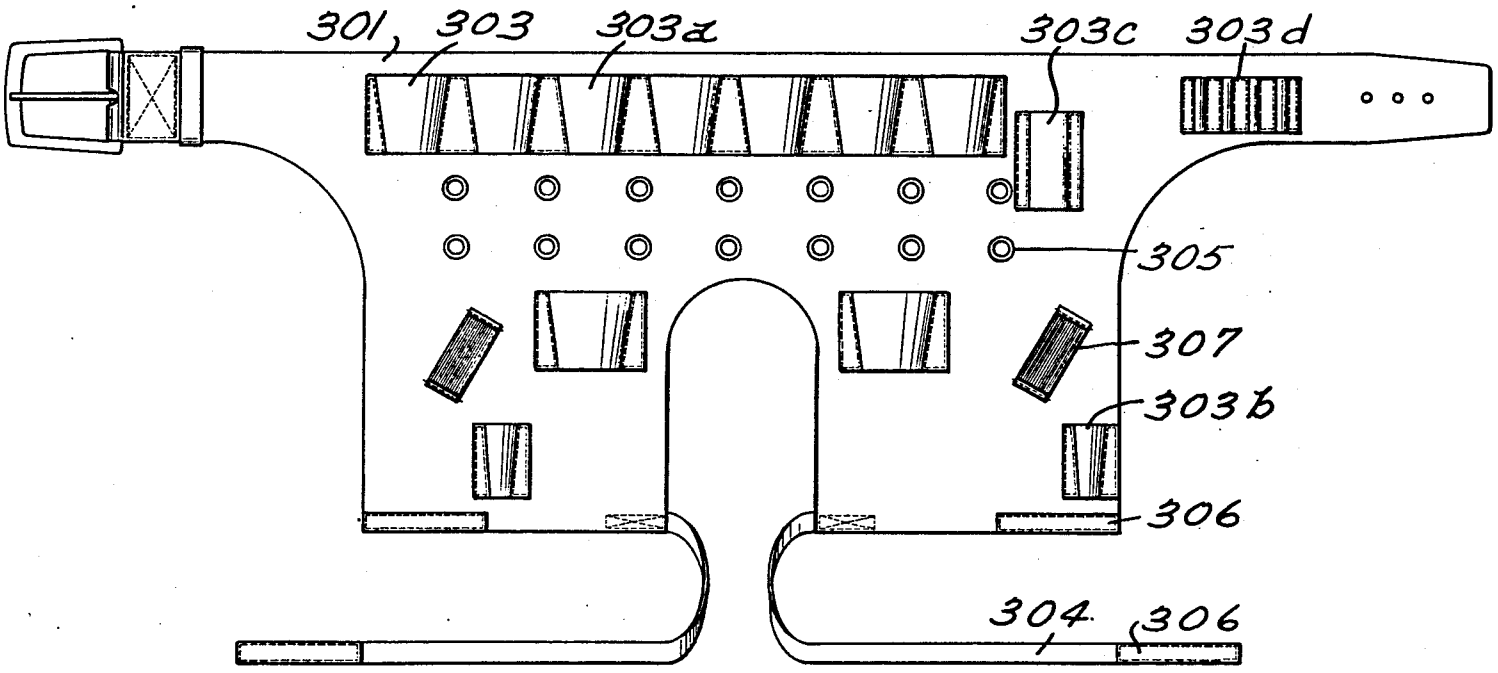
FIG. 20 shows an example of a belted waist-mountable support in accordance with the invention for a plurality of club heads and certain ancillary equipment.

FIG. 20 corresponds to general reference 3 in FIG. 1, and illustrates features of an alternative piece of carrying equipment. It will be appreciated that the set of equipment may contain either, or both, of the embodiments of FIGS. 19 and 20. If both are present a choice, or use by two persons, is made available.

An adjustable leather belt 301 is integral with two leg flap support portions 302, with thin securing strips 304 attached at inner lowermost edge regions. The surface of this structure is provided with holder loops 303, of various configurations. Some, such as 303*a* define an internal space which is rather constricted and larger at the top than at the bottom. These are useful for holding iron clubheads by the head with the neck protruding beneath. Nine such loops are shown in FIG. 20. Others, as at 303*b*, are for a neck holder more suitable for wooden clubheads carrying the neck in the loop 303*b* and the head in elastic strip 307 in each instance. Still others, as at 303*c*, are simple non-tapering loops. for holding e.g. a score-card pen or the like. Others again, as at 303*d*, are formed as multiple small loops to hold a number of tees.

Additional features of the carrying equipment include rim-reinforced vent holes 305, and VELCRO (RTM) securing pads 306 at the ends of strips 304 and the outer lower corners of the flaps.

In use, the belt 301 is fixed around a players' waist with the flap supports behind the player, so as not to interfere with his play. The strips 304 are fastened around his legs by joining the various Velcro pads 306 as necessary.

Figure 21:
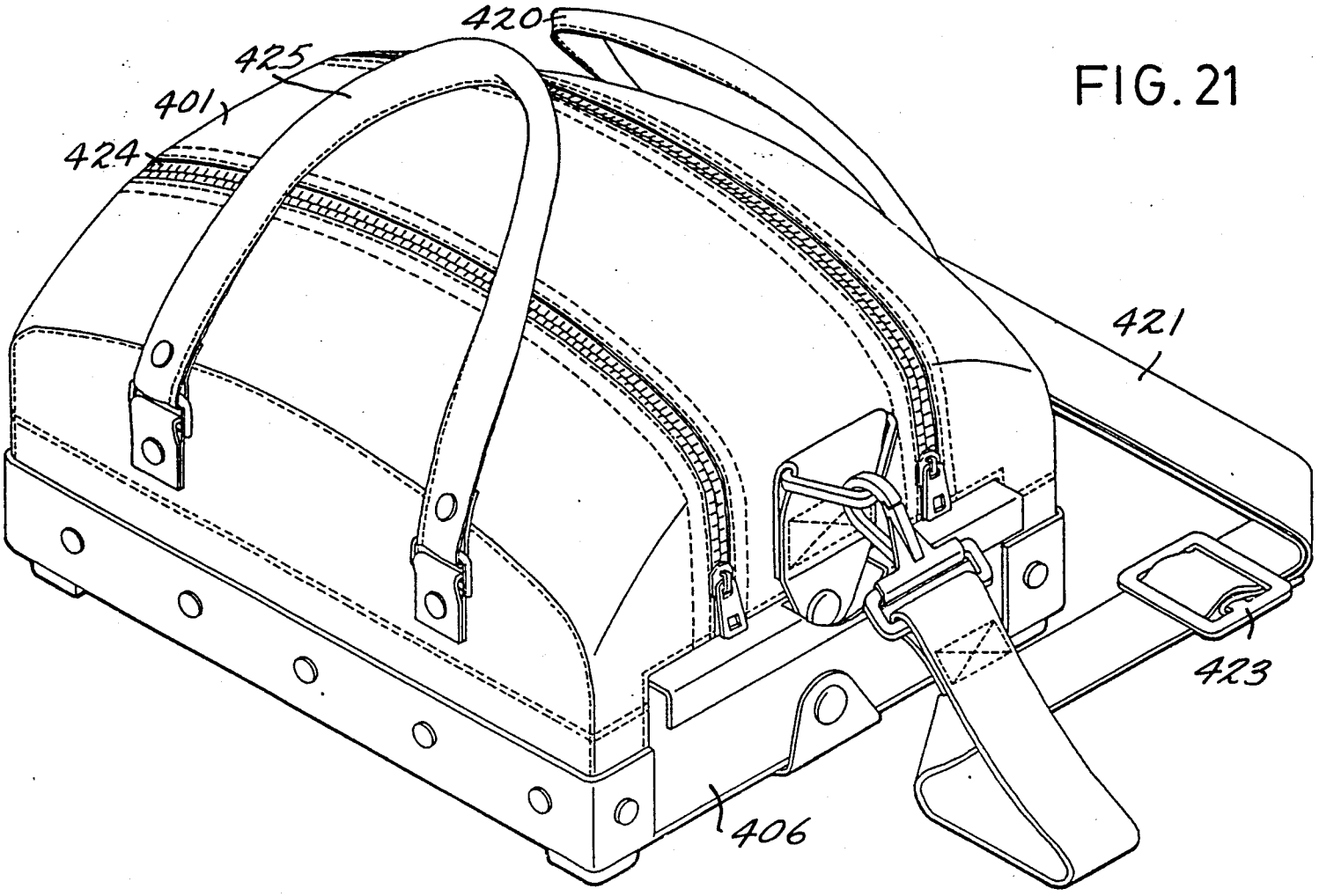
FIG. 21 shows an example of a carrying bag for a full set of golf heads, in accordance with the invention.

FIGS. 21 to 23 correspond to general reference 4 in FIG. 1 and illustrate features of transport equipment by means of which the golf club set can be carried to or from the course.

Such equipment, as already described above, generally consists of top-openable bag 401., loading zones 402, 403 for irons 404 and woods 405. and drawer 406 for holding balls 407.

FIG. 21 shows in more detail that the bag has side handles 420, meeting over the top for easy carrying, and a shoulder-strap 421, for alternative carrying. detachable at 422 and adjustable in length at 423. The bag has two parallel zip-fasteners 424. 425, separately openable (see FIG. 1) to accommodate a full set of 14 golf club heads. nine irons 404 in one side and five woods 405 in the other side of the bag.

FIGS. 22 and 23 show how the heads are accommodated and held in a frigid insert of moulded foamed synthetic polymer 426. This moulded insert 426 has suitable holding recesses 427 (for irons) and 428 (for woods) as shown in FIG. 22, and is of a bridge shape with two support legs 429. The necks of the irons or woods extend in holes in legs 429, and their heads are held separately and without contact in the recesses 427 and 428. Between legs 429 is defined a space 430, accommodating a drawer 406, itself longitudinally divided at 431 to hold golf balls or like small items of play.

Figures 24A, 24B, 24C:
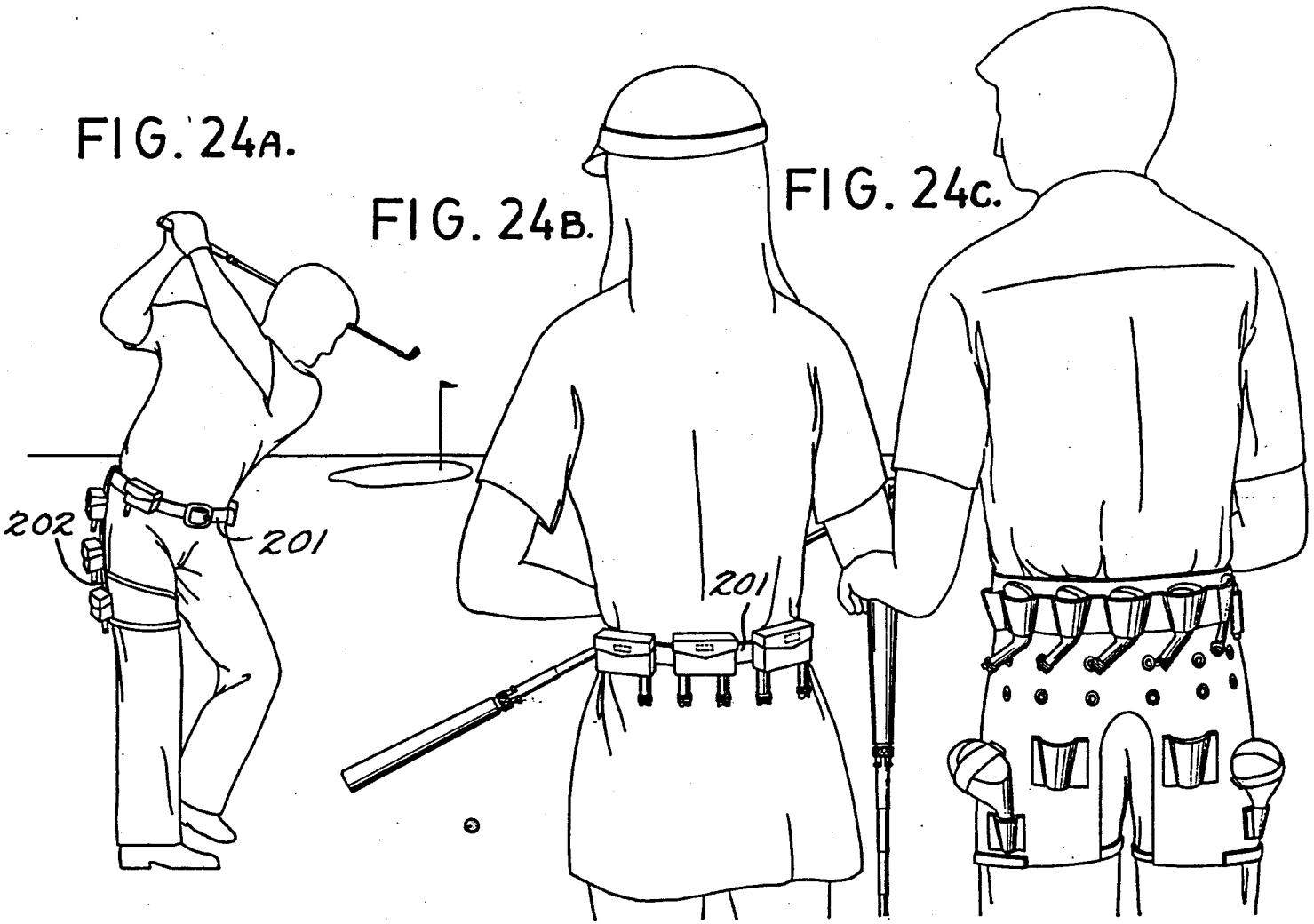
FIG. 24 shows three people wearing selected combinations of equipment during a game of golf.

Finally, FIG. 24 shows three players each wearing parts of the set of equipment.

Player A, about to drive is wearing the equipment generally indicated at 2. It will be apparent that his drive is not encumbered in any way by the various boxes on the belt 201 or leg strap 202. Player B. a woman, is wearing only the more suitable waist portion 201 of such equipment. Player C is wearing the more elaborate structure generally referenced at 3, for carrying numbered heads for easy access. Again, neither players B or C will be encumbered in movement by wearing the equipment as shown.

We claim:

1. A set of equipment for playing golf, comprising:

(a) a set of golf club heads corresponding to a conventional golf club set;

(b) a shaft, configured at a first end thereof for ready assembly or disassembly therewith of a selected head and for locking the head into position between such assembly and disassembly and at a second end thereof for ready relative longitudinal adjustment of an end grip portion to provide different selected effective shaft lengths;

(c) graspable transportation means dimensioned and shaped to accommodate the said full set of golf club heads; and (d) at least one wearable carrying means to accommodate a selection of such heads during a round of golf, secured to or part of a waist belt in such a location as not to interfere with a player's movements and presenting the heads for ready choice of a selected head for interchange on the shaft when necessary, wherein the assembly configuration between the shaft and any head comprises:

(a) on the head, a straight hollow neck of generally cylindrical internal form and possessing towards an inner end of a cylindrical hollow an internal collar with a pair of opposed diametral interruptions, and (b) on the shaft, a cylindrical end portion dimensioned to fit within the cylindrical hollow, having an endmost region which is of a smaller diameter and possesses a pair of opposed diametral protrusions, capable of passage through the interrupted portions of the internal collar within the neck and capable of engagement beneath the collar when the shaft is twisted through 90° relative to the head.

2. A set of equipment as claimed in claim 1 in which the shaft/head assembly configuration comprises:

(a) on the head (i) a liner member fixed within the neck to define the cylindrical hollow and interrupted shoulder, (ii) external screw threads spaced from the end of the neck, (iii) two sloping edges each extending around one-quarter of the perimeter of the end of the neck to a stop surface, (b) on the shaft (i) a connecting rod extending from a tubular shaft end to exhibit the endmost region with its diametrically opposed protrusions, (ii) a diametral pin extending through the tubular shaft end and connecting rod, to project to either side of the shaft inwards from its end, (iii) an internally threaded conical sleeve slidable on the shaft until it engages the projecting pin ends, and engageable with the neck external threads: whereby when the connecting rod endmost portion is pushed past the interrupted collar, it can be relatively twisted with the pin ends passing down the neck and sloping edges until the stop surfaces are encountered and when the conical sleeve is engaged with the external neck threads the assembly is tightened.

3. A set of equipment as claimed in claim 2 further comprising (a) at least one temporary shaft end cover engageable with the internal threads of the sliding conical sleeve and (b) a plurality of temporary club neck-end covers engageable with the external threads of the neck.

4. A set of equipment for playing golf, comprising:

(a) a set of golf club heads corresponding to a conventional golf conventional golf club set;

(b) a shaft, configured (i) at a first end thereof for ready assembly or disassembly of a selected head and for locking of the head into position between such assembly and disassembly and (ii) at a second end thereof for ready relative longitudinal adjustment of an end grip portion to give different selected effective shaft lengths;

(c) graspable transportation means dimensioned and shaped to accommodate the said full set of golf club heads; and (d) at least one wearable carrying means to accommodate a selection of such heads during a round of golf, secured to or part of a waist belt in such a location as not to interfere with a player's movements and presenting the heads for ready choice of a selected head for interchange on the shaft when necessary, wherein the assembly configuration between the shaft and its length-adjustable grip comprises:

(a) towards the rearward end of the shaft, at least one axially protruding pin, and (b) within the cylindrically hollow grip around the said rearward shaft end a longitudinally extending groove and a plurality of spaced side grooves communicating therewith, all dimensioned to accommodate the protruding pin end, whereby (a) the shaft and grip can be relatively twisted out of a first longitudinally stable configuration, at which the pin end lies in a side groove, into a second configuration in which the pin lies in the longitudinally extending groove, (b) the shaft and grip can be relatively moved longitudinally, and (c) the shaft and grip can be relatively twisted back into a second longitudinally stable configuration with the pin end in another side groove.

5. A set of equipment as claimed in claim 4 in which the shaft/grip assembly configuration comprises:

(a) at a shaft rearward tubular end a stopper secured by two spaced pins protrudingly axially from the shaft, and (b) a two-part grip comprising an external cover and an internal liner fixed therein and exhibiting a straight longitudinal groove with a plurality of side grooves, equispaced at a distance equal to the pin separation on the shaft, communicating therewith; the forward end of the liner extending from the external cover around the shaft, being split longitudinally into pressing fingers and being threaded externally to accommodate an internally threaded tightening collar turnable to tighten or loosen the fingers on the shaft and thereby to prevent, when tightened, undesired relative twisting.

6. A set of equipment as claimed in claim 4 in which the shaft rearward portion is marked with a scale at least partly located beneath the grip, so as to indicate the effective shaft length at different grip longitudinal positions.

7. A set of equipment for playing golf, comprising:

(a) a set of golf club heads corresponding to a conventional golf club set;

(b) a shaft, configured (i) at a first end thereof for ready assembly or disassembly of a selected head and for locking of the head into position between such assembly and disassembly and (ii) at a second end thereof for ready relative longitudinal adjustment of an end grip portion to give different selected effective shaft lengths;

(c) graspable transportation means dimensioned and shaped to accommodate the said full set of golf club heads the graspable transportation means containing a holder for holding a full set of club heads, the transportation means including a holder for a row of heads for irons and a row of heads for woods; and (d) at least one wearable carrying means to accommodate a selection of such heads during a round of golf, secured to or part of a waist belt in such a location as not to interfere with a player's movements and presenting the heads for ready choice of a selected head for interchange on the shaft when necessary, wherein the holder is a bridge-shaped molded member including two rows of cylindrical recesses, one in each leg, to receive the golf club necks, and two rows of shaped grooves at an upper surface to prevent movement and damage of the heads.

8. A set of equipment as claimed in claim 1, in which a drawer for holding ancillary equipment is located between the legs of the bridge-shaped molded member.

9. A set of equipment for playing golf, comprising:

(a) a set of golf club heads corresponding to a conventional golf club set;

(b) a shaft, configured (i) at a first end thereof for ready assembly or disassembly of a selected head and for locking of the head into position between such assembly and disassembly and (ii) at a second end thereof for ready relative longitudinal adjustment of an end grip portion to give different selected effective shaft lengths;

(c) graspable transportation means dimensioned and shaped to accommodate the said full set of golf club heads; and (d) at least one wearable carrying means to accommodate a selection of such heads during a round of golf, secured to or part of a waist belt in such a location as not to interfere with a player's movements and presenting the heads for ready choice of a selected head for interchange on the shaft when necessary, wherein the wearable carrying means comprises a waist belt having a plurality of upwardly openable lidded head-carrying boxes fixed around the belt in spaced locations not interfering with the player's movement.

10. A set of equipment as claimed in claim 9 in which each head-carrying box has a generally rectangular floor with two holes towards opposite corners thereof; whereby one club head of wood, or two of iron, can be accommodated per box with neck portions extending downwards through the holes.

11. A set of equipment for playing golf, comprising:

(a) a set of golf club heads corresponding to a conventional golf club set;

(b) a shaft, configured (i) at a first end thereof for ready assembly or disassembly of a selected head and for locking of the head into position between such assembly and disassembly and (ii) at a second end thereof for ready relative longitudinal adjustment of an end grip portion to give different selected effective shaft lengths;

(c) graspable transportation means dimensioned and shaped to accommodate said set of golf club heads; and (d) at least one wearable carrying means to accommodate a selection of such heads during a round of golf, secured to or part of a waist belt in such a location as not to interfere with a player's movements and presenting the heads for ready choice of a selected head for interchange on the shaft when necessary, wherein the wearable carrying means comprises a waist belt having attached thereto a generally vertical leg or thigh strap with leg-encircling fastener straps projecting therefrom, the straps having a plurality of upwardly openable lidded head-carrying boxes fixed along the strap at spaced locations not interfering with the movements of the player.

* * * * *